US008991285B2

(12) United States Patent
Mennecke, IV

(10) Patent No.: US 8,991,285 B2
(45) Date of Patent: Mar. 31, 2015

(54) DOUBLE ACTION INTERNALLY GEARED ROTARY TOOL

(76) Inventor: Ernest A. Mennecke, IV, Wheaton, IL (US)

( * ) Notice: Subject to any disclaimer, the term of this patent is extended or adjusted under 35 U.S.C. 154(b) by 126 days.

(21) Appl. No.: 13/490,420

(22) Filed: Jun. 6, 2012

(65) Prior Publication Data

US 2013/0139653 A1 Jun. 6, 2013

Related U.S. Application Data

(60) Provisional application No. 61/493,631, filed on Jun. 6, 2011.

(51) Int. Cl.
*B25B 13/46* (2006.01)

(52) U.S. Cl.
CPC ..... *B25B 13/467* (2013.01); *B25B 13/465* (2013.01)
USPC ..... 81/58.1; 81/57.3; 81/62

(58) Field of Classification Search
USPC ..... 81/58.1, 61, 62, 57.3, 57.31, 57.39
See application file for complete search history.

(56) References Cited

U.S. PATENT DOCUMENTS

| | | | | | |
|---|---|---|---|---|---|
| 2,520,443 | A * | 8/1950 | Seaquist | ..... | 81/57.31 |
| 3,467,231 | A | 9/1969 | Haznar | | |
| 3,587,364 | A * | 6/1971 | Peyre | ..... | 81/57.39 |
| 3,945,274 | A * | 3/1976 | Annett, II | ..... | 81/58.1 |
| 4,147,076 | A | 4/1979 | Wright et al. | | |
| 4,807,500 | A | 2/1989 | Main | | |
| 5,058,463 | A | 10/1991 | Wannop | | |
| 5,105,688 | A * | 4/1992 | Williams, III | ..... | 81/57.31 |
| 5,537,899 | A | 7/1996 | Diedrich | | |
| 5,603,393 | A | 2/1997 | Ghode et al. | | |
| 7,168,340 | B1 | 1/2007 | Green | | |
| 7,770,494 | B2 * | 8/2010 | Cornwell et al. | ..... | 81/57.3 |

* cited by examiner

*Primary Examiner* — Hadi Shakeri
(74) *Attorney, Agent, or Firm* — Erickson Law Group, PC

(57) ABSTRACT

The invention provides a ratchet tool that includes a tool head, a drive including a sun gear, a ratchet mechanism, and planet gears mounted to a carrier and meshed with the sun gear. The tool head has drive teeth meshed with the planet gears. The ratchet mechanism is mounted to the tool head and is operative to directly couple the tool head to the input when the tool head is rotated in a first direction and to uncouple the tool head from the input when the tool head is rotated in a second opposite direction. Rotation of the tool head in the second direction, while the user holds the carrier stationary, rotates the drive in the first direction.

19 Claims, 5 Drawing Sheets

DOUBLE ACTION INTERNALLY GEARED ROTARY TOOL

This Application claims the benefit of U.S. Provisional Application Ser. No. 61/493,631 filed Jun. 6, 2011.

TECHNICAL FIELD OF THE INVENTION

The present invention relates to tools, and in particular to ratchet mechanism-type tools.

BACKGROUND OF THE INVENTION

Ratchet mechanism-type tools, such as wrenches, are used to allow for the application of torque to an object, such as a nut or bolt head without the need for the removal and replacement of the wrench upon the nut or bolt head at the end of each rotational movement to apply a further rotational movement. The time necessary to either install or remove a nut or bolt is reduced with these types of wrenches.

The ability of ratchet type wrenches to accomplish the above time savings is due to an associated lost motion. One direction of rotational movement of the wrench applies torque, while the opposite rotational movement is in effect lost motion, in which no torque is applied. Accordingly, upon the opposite rotational movement, there is no rotation of the nut or bolt.

Because there is no rotation of the nut or bolt head accomplished when the wrench is rotated in the opposite direction, known ratchet wrenches are less effective in areas where the clearance between surrounding objects and the wrench handle allows only a restricted rotational swing of the handle. In such areas, with the rotation in the opposite direction not adding to the rotational movement of the nut or bolt head, more rotational back-and-forth rotation is necessary in order to install or remove a nut or bolt.

The present inventor has recognized a need to provide a dual acting ratchet tool that can utilize limited rotation movement of the tool handle in both rotational directions to forcibly rotate an object in a single rotation direction. The present inventor has recognized a need to provide such a tool that is compact in design for use in tight areas with reduced clearance for rotational movement of the tool handle. The present inventor has recognized a need to provide such a tool that is of rugged construction and is cost effectively manufactured.

SUMMARY OF THE INVENTION

The present invention provides a ratchet tool that is compact and effective and which allows for driving an output of the tool is a constant direction during both the drive stroke and the opposite return stroke.

The invention provides a ratchet tool that includes a tool head, a drive including a sun gear, a ratchet mechanism, a carrier and planet gears. The tool head has a cavity with an drive axis and an inside circumference with drive teeth extending parallel to the drive axis around the inside circumference. The drive teeth can be provided on a separate inner gear fixed into the tool head. The drive includes a drive output to impart rotation to an object such as a nut or bolt head, and a drive input to receive torque for rotating the output. The sun gear of the drive has sun gear teeth extending parallel to the drive axis around an outer circumference of the sun gear. The ratchet mechanism is mounted to the tool head and is operative to directly couple the tool head to the input when the tool head is rotated in a first direction and to uncouple the tool head from the input when the tool head is rotated in a second opposite direction. The carrier has a carrier outside surface engageable by a user's finger. The carrier is rotationally mounted to the tool head to rotate about the drive axis.

The plurality of planet gears are spaced-apart and rotationally mounted to the carrier. Each planet gear has planet gear teeth extending parallel to the tool drive axis. The planet gears fit meshed between the drive teeth and the sun gear teeth. Rotation of the tool head in the second direction, while the user holds the carrier outside surface stationary, rotates the drive in the first direction even though the ratchet has uncoupled the tool from the input.

Accordingly, for example, if the ratchet is set to couple the tool head to the drive in the first direction being a clockwise tightening direction, a bolt head can be tightened when the tool head is rotated in the first direction by torque from the tool head through the ratchet mechanism and into the input. This is the customary operation of a ratchet wrench. The user is not holding the carrier stationary when rotating in this first direction.

When the tool head is rotated in the return stroke, in the second, opposite direction, that is counterclockwise in this example, the ratchet uncouples the tool head from the input. If during this return stroke the user holds the carrier stationary, the planet gears will drive the sun gear to rotate in the opposite direction of the return stroke, in the first direction, that is clockwise in this example even though the ratchet has uncoupled the tool from the input. Thus, in this example, during rotation of the tool head in both the clockwise and counterclockwise directions, the output is driven in the clockwise direction.

If the ratchet operation is reversed, for example for loosening a bolt head, the first direction is now counterclockwise and the opposite effect is realized, for both the initial stroke and the return stroke the output is driven counterclockwise.

As an enhancement, the drive input comprises a cylinder coaxially connected to the sun gear, and wherein the ratchet mechanism comprises at least one pawl mounted to the cylinder and engageable to the drive teeth to prevent relative rotation between the cylinder and the tool head when the tool head is rotated in the first direction but to allow relative rotation between the tool head and the cylinder when the tool head is rotated in the second direction.

As an exemplary embodiment, the drive output comprises a socket drive.

As an enhancement, the drive output, the sun gear and the cylinder are all formed together as a unitary part.

As an exemplary embodiment, the carrier comprises a round disk.

As an exemplary embodiment, the tool head comprises an outer body and an inner gear fixedly mounted into the outer body, the inner gear providing the drive teeth.

As an exemplary embodiment, the inner gear has outer threads and the outer body has inner threads and the inner gear is threaded into the outer body.

As an enhancement, the ratchet mechanism is reversible such that the first direction is either clockwise or counterclockwise.

As an enhancement, the drive input comprises a cylinder coaxially connected to the sun gear. The ratchet mechanism comprises a selector having a finger-engageable operator connected to a selector shaft that is elongated parallel to the drive axis. A spring tube extends transversely through the selector shaft, and a spring residing inside the spring tube. Pins extend from opposite ends of the spring to be urged away from each other by the spring. Two pawls are each pressed by a pin away from each other. The cylinder has an axial bore to receive the selector shaft and a diametric bore to receive the tube, and the pawls are mounted to the cylinder to extend between the drive teeth and an outside circumference of the cylinder on opposite sides of the cylinder. The pawls are engageable to the drive teeth to prevent relative rotation between the cylinder and the tool head when the tool head is rotated in the first direction but to allow relative rotation between the tool head and the cylinder when the tool head is rotated in the second direction.

The diametric bore can be oversized or outwardly fan shaped to allow room for rotation of the spring tube about the drive axis within the cylinder. The rotation of the spring tube causes each pin to pivot a respective pawl to a degree that reverses operation of the ratchet mechanism from the first direction being clockwise to the first direction being counter-clockwise.

Numerous other advantages and features of the present invention will become readily apparent from the following detailed description of the invention and the embodiments thereof, from the claims and from the accompanying drawings.

DESCRIPTION

Figure 3:
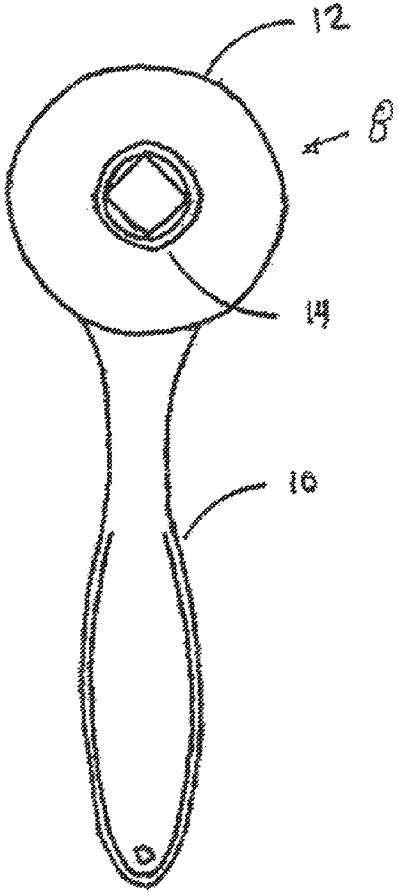
FIG. 3 is a front view of the ratchet tool of FIG. 1.
Figure 2:
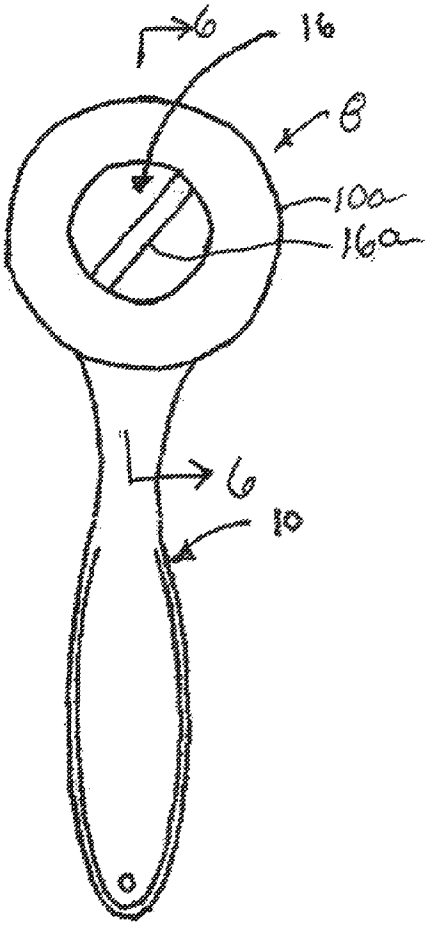
FIG. 2 is a rear view of the ratchet tool of FIG. 1.
Figure 1:
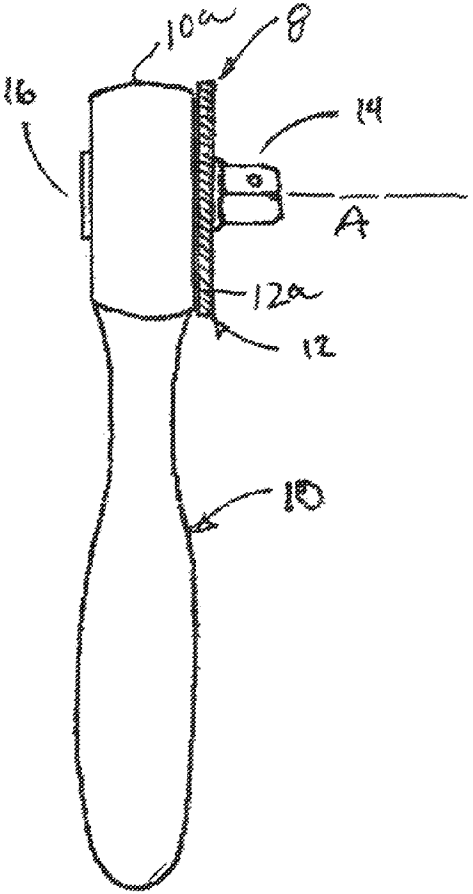
FIG. 1 is a side view of a ratchet tool of the present invention.
Figure 4:
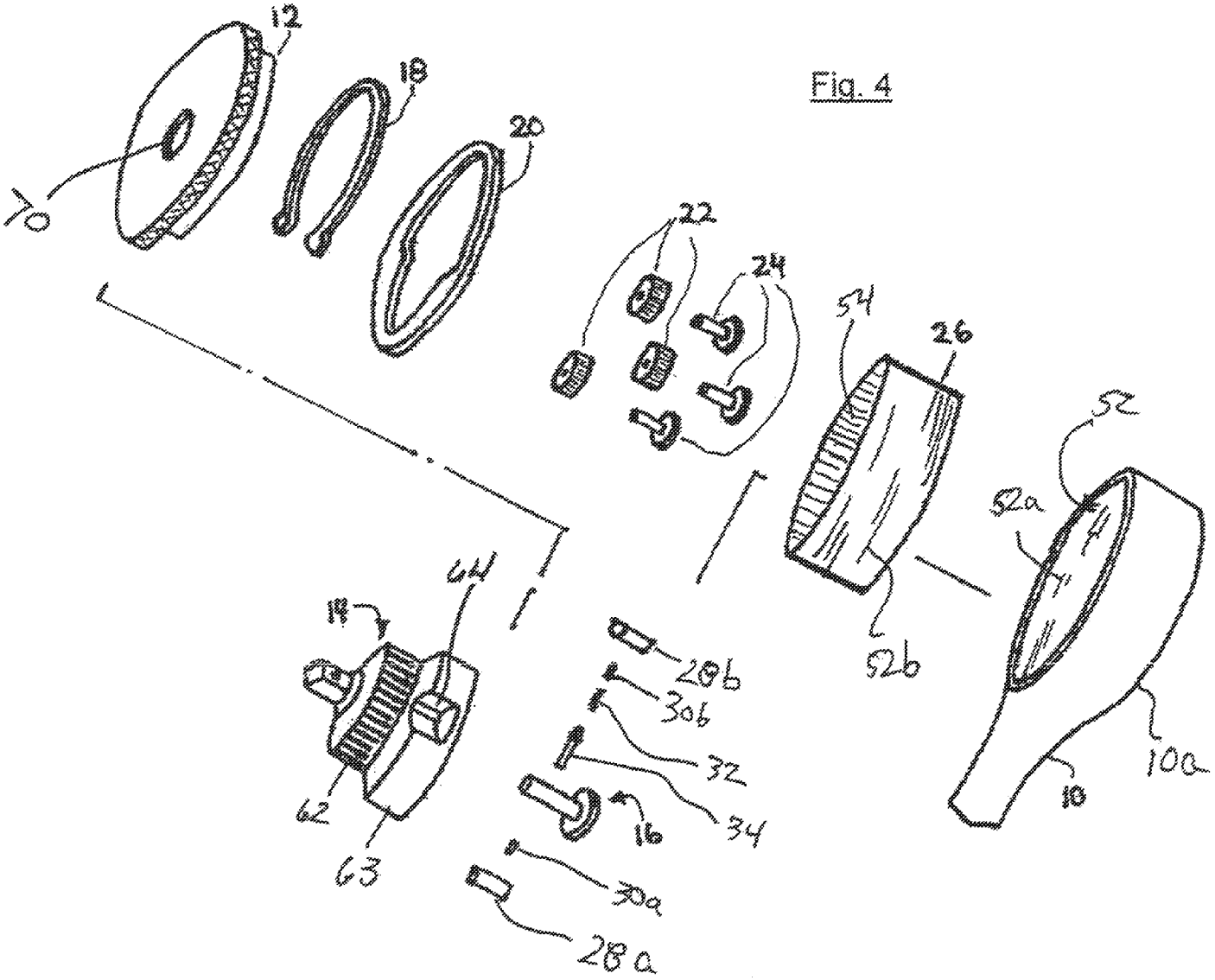
FIG. 4 is a fragmentary, exploded perspective view of the ratchet tool of FIG. 1.
Figure 5:
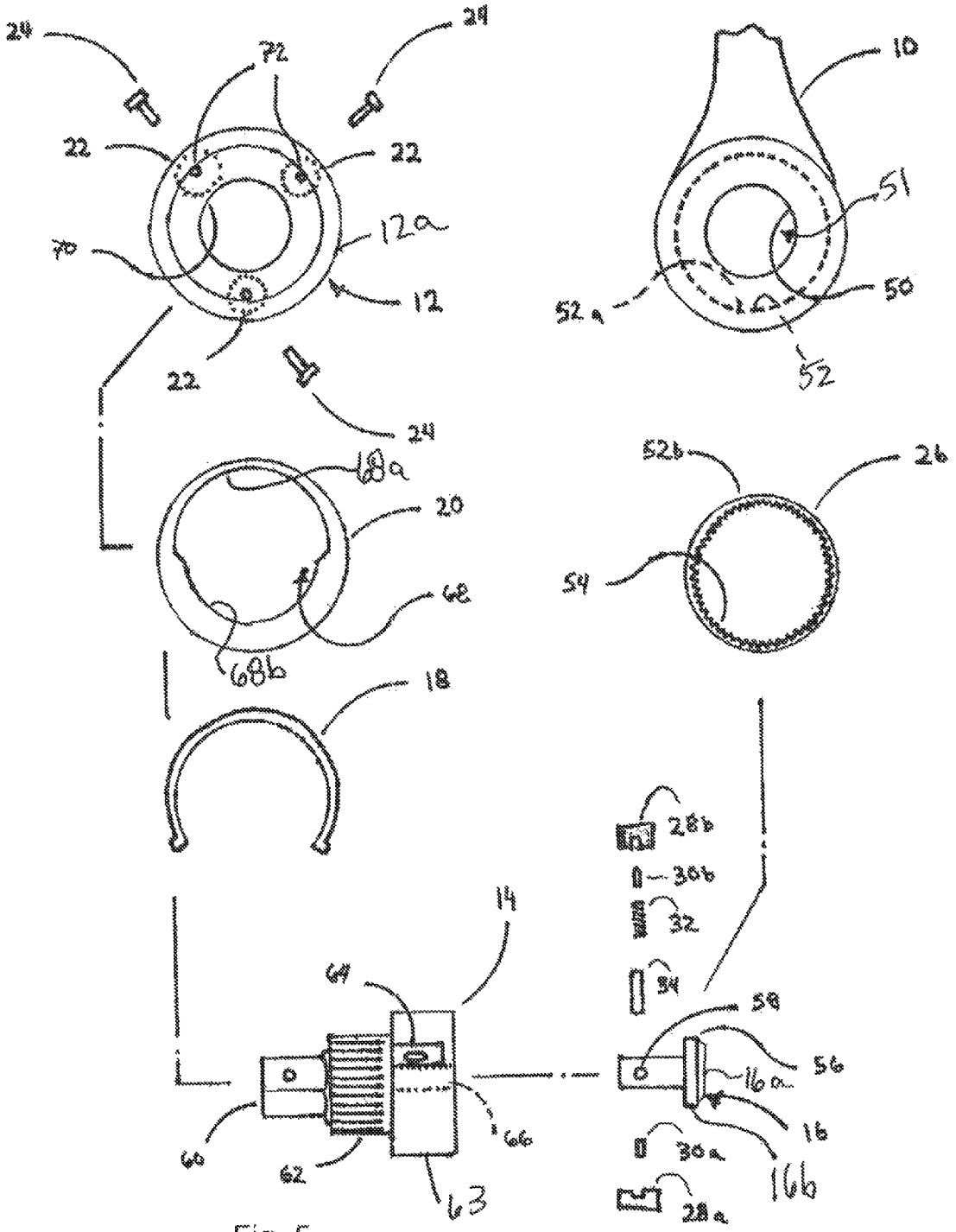
FIG. 5 is a fragmentary exploded plan view of the ratchet tool in FIG. 1.
Figure 6:
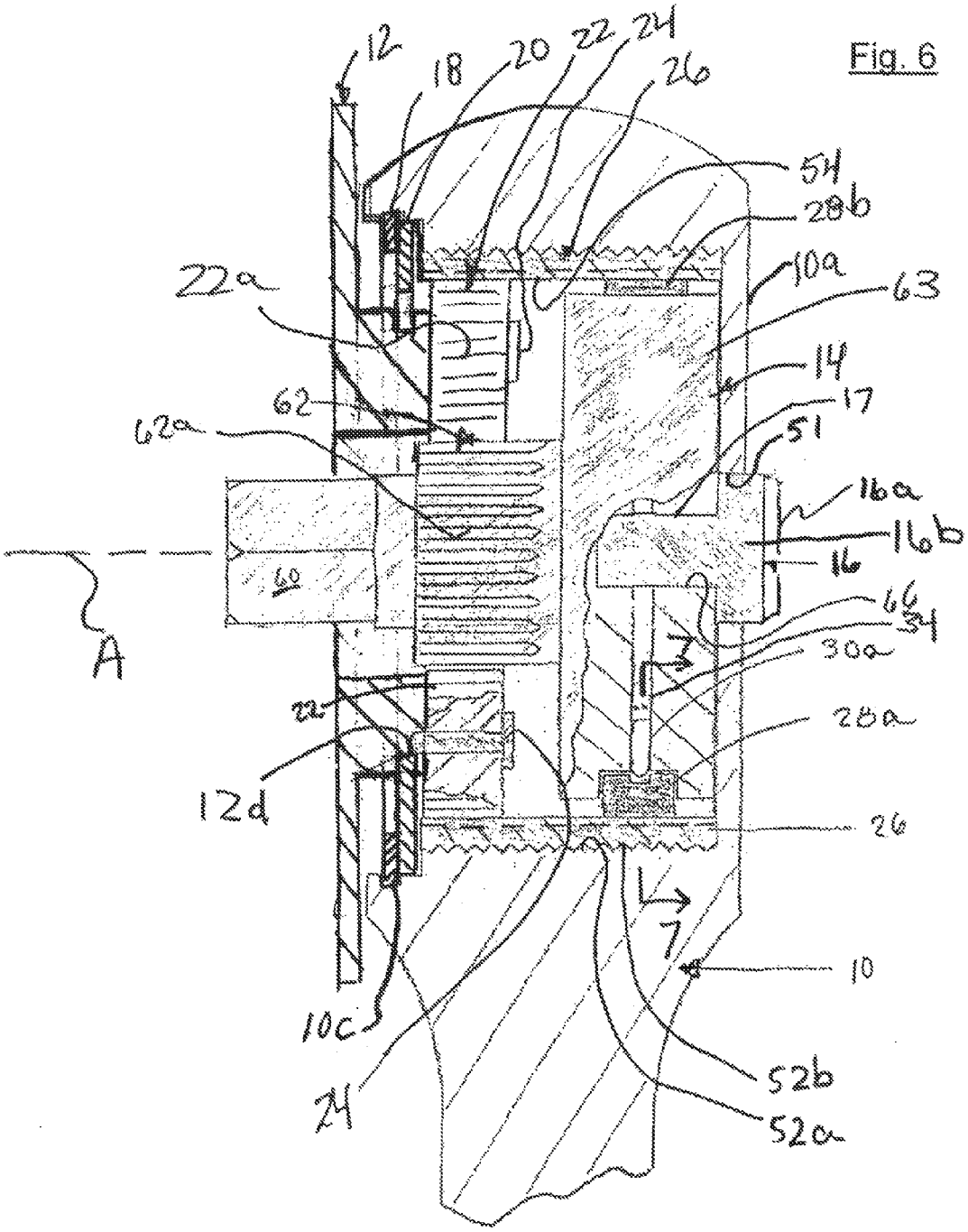
FIG. 6 is a fragmentary sectional view taken generally along lines 6-6 of FIG. 2.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIGS. 1-7 illustrate an embodiment of a ratchet tool 8 of the present invention. The tool 8 includes a handle 10, which can be of a one-piece construction and which includes a tool head 10*a* which also serves as a frame. A carrier disk 12 having a round circumference is located adjacent to a tool head 10*a*. An output drive 14 extends from the tool head 10*a*. A selector switch 16 having a turning handle 16*a* allows for reversing tool ratchet direction. For purpose of description the tool has a drive axis A, shown in FIGS. 1 and 6.

FIGS. 4-7 illustrates internal parts in more detail. A snap ring 18 and a carrier retainer 20 maintain the tool in an assembled state. Three planet gears 22 having planet gear teeth 22*a* that are elongated in a direction parallel to the drive axis A, are spaced apart and are rotatably mounted on pins 24 or bolts to the carrier 12. The output drive 14 includes a sun gear 62, a drive shaft 60 and a base cylinder 63. The output drive 14 can be of a one-piece unitary construction.

The selector switch 16 holds a ratchet assembly that includes pawls 28*a*, 28*b*, pins 30*a*, 30*b*, a spring 32 and a spring tube 34. When assembled, the pins 30*a*, 30*b* are partially inserted into opposite ends of the spring tube 34 with the spring within the spring tube urging the pins 30*a*, 30*b* outwardly in opposite directions.

The switch 16 includes a round head 16*b* upon which extends the handle 16*a*. Extending from the round head 16*b* on an opposite side from the handle 16*a* is a selector shaft 17. The selector shaft 17 fits with close clearance into a bore 66 in the cylinder 63. A cross-bore 58 through the selector shaft 17 holds the spring tube 34. The parts 28*a*-34 fit into the cylinder 63 within an oppositely flared, expanding outwardly, through-passage 67 formed into the cylinder 63 that is open through the bore 66. The spring tube 34 being captured in the passage 67 and in the cross-bore 58 secures the switch 16 to the cylinder 63. By rotating the handle 16*a*, the selector shaft 17 rotates within the bore 66 and the spring tube 34 rotates therewith through the through-passage 67. The spring 32 and the pins 30*a*, 30*b* move with the rotating spring tube 34.

The sun gear 62 is formed into or cut into the output drive 14. The sun gear 62 has sun gear teeth 62 that are elongated in a direction parallel to the drive axis A, which mesh with the planetary gear teeth 22*a* of the planetary gears 22.

The output shaft 60 fits through parts 18, 20 and 12. The retainer 20 holds the carrier 12 in place. The pins 24 holds planet gears 22 to the carrier via holes 72 which can be threaded to accept threaded pins.

Within the ratchet mechanism frame, or in this case the tool head 10*a*, a cylindrical cavity 52 of limited depth has internal threads 52*a* to receive the external threads 52*b* of the inner gear 26. When the inner gear 26 is fully screwed into the cylindrical bore 52 of the tool head 10*a*, a key (not shown) may be inserted firmly secure the two parts together. The inner circumference of the inner gear 26 is machined to have teeth 54 that are elongated in a direction parallel to the drive axis A, to mesh with the planetary gears 22 and the pawls 28*a*, 28*b*.

The base cylinder 63 has machined semi-cylindrical seats 64, located on diametrically opposite sides of the cylinder 63, which house the ratchet pawls 28*a*, 28*b*.

The selector switch head 16*b* has an outer circumference 56 which matches an inner circumference 50 of an opening 51 in the back of the tool head 10*a*, the opening 51 acting as a bearing journal for the switch 16.

The carrier disk 12 is thin with a round circumference. An outer edge 12*a* of the carrier disk 12 may be knurled for greater grip. The carrier disk 12 includes an inner round opening 70 for passing the output drive shaft 60 therethrough.

The carrier disk 12, including the attached planet gears 22 is held into the tool head 10*a* by the carrier retainer 20. The retainer has a compound opening 68 with a large section 68*a* and a smaller diameter section 68*b*. The larger opening 68*a* allows for the positioning of the retainer 20 into a slot 12*d* formed into the carrier 12, wherein the smaller diameter opening section 68*b* will be effectively captured into the slot 12*d* once the retainer 20 is fit onto and then shifted on the carrier 12. The snap ring 18 surrounds the carrier 12 and snaps into an annular slot 10*c* in the tool head 10*a*. The snap ring 18 abuts the retainer 20 to prevent the retainer 20 and thus the carrier 12 from pulling out of the tool head 10*a*.

Figure 7:
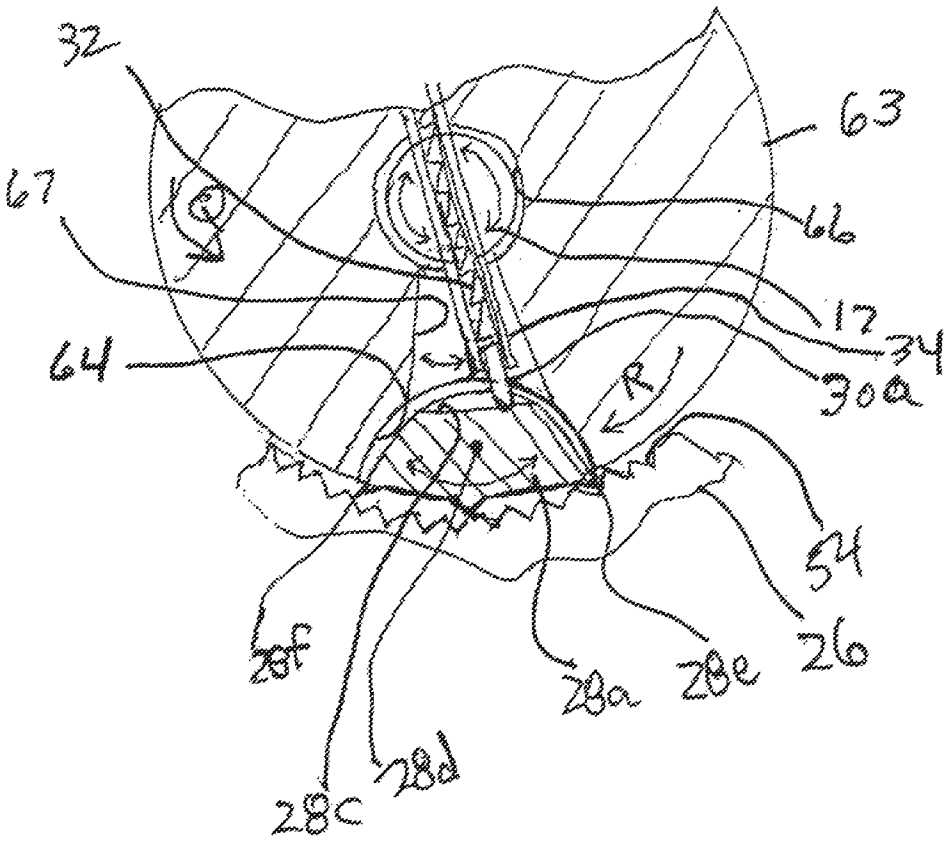
FIG. 7 is a fragmentary sectional view taken generally along lines 7-7 of FIG. 6.

FIG. 7 illustrates one type of ratchet pawl arrangement. Only one pawl 28*a* is illustrated with the understanding that the opposite pawl 28*b* is configured rotationally symmetrical about the drive axis A and would operate with in similar fashion in tandem with the first pawl 28*a*. Other types of pawl arrangements are encompassed by the invention including those described in U.S. Pat. Nos. 4,807,500; 4,147,076; 3,467,231; 5,603,393 and 5,537,899; herein incorporated by reference.

As shown in FIG. 7, the pawl 28*a* has a semi-cylindrical outer circumference that fits closely into the semi-cylindrical seat 64. The pawl 28*a* is captured between the seat 64 and the teeth 54 of the inner gear 26. When urged by the pin 30*a*, the pawl 28*a* can smoothly rotate within and be guided by the seat 64. The spring 32 retained in the spring tube 34 urges the pin 30*a* against a right side (FIG. 7) of a slot 28*c* formed on a back side of the pawl 28*a*. This rotates the pawl 28*a* clockwise about a pawl axis 28*d* that is parallel to the drive axis A. An end tooth 28*e* is positioned to engage teeth 54 of the gear 26 while an opposite end tooth 28*f* is drawn away from the teeth 54. The tooth 28*e* allows the cylinder 63 to relatively rotate with respect to the gear 26 in the cylinder direction R but not in the cylinder direction Q. The left face (FIG. 7) of the tooth 28*e* slips over the teeth 54 when the cylinder relatively rotates in the cylinder direction R but the right face (FIG. 7) of the tooth 28*e* prevents relative rotation between the cylinder 63 and the gear 26 in the cylinder direction Q. When the selector shaft 17 is rotated clockwise in FIG. 7, the spring tube is rotated clockwise and the pin 30*a* presses a left side of the slot 28*c* and the pawl 28*a* is rotated counterclockwise about the pawl axis 28*d* until the tooth 28*f* engages the teeth 54 and the tooth 28*e* is drawn away from the teeth 54. Now, the tooth 28*f* allows the cylinder 63 to relatively rotate with respect to the gear 26 in the cylinder direction Q but not in the cylinder direction R. The right face (FIG. 7) of the tooth 28*f* slips over the teeth 54 when the cylinder relatively rotates in the cylinder direction Q but the left face (FIG. 7) of the tooth 28*f* prevents relative rotation between the cylinder 63 and the gear 26 in the cylinder direction R.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A ratchet tool comprising:

a tool head having a cavity with a drive axis and an inside circumference with drive teeth extending parallel to the drive axis around the inside circumference;

a drive having a drive output to impart rotation to an object and a drive input within the cavity to receive torque for rotating the output, the drive input and output being directly coupled, and having a sun gear having sun gear teeth extending parallel to the drive axis around an outer circumference of the sun gear, the drive input comprises a cylinder coaxially connected to the sun gear, the cylinder having at least one concave seat;

a ratchet mechanism mounted between the tool head and the drive input, the ratchet mechanism comprises at least one pawl mounted at least partly into the at least one seat and engageable to the drive teeth and operative to directly couple the tool head to the input when the tool head is rotated in a first direction and to uncouple the tool head from the input when the tool head is rotated in a second opposite direction, wherein while the tool head is rotated in the first direction, the ratchet mechanism couples for common rotation the drive teeth of the tool head to the sun gear of the drive;

a carrier having a carrier outside surface engageable by a user's finger, the carrier rotationally mounted to the tool head to rotate about the drive axis;

a plurality of planet gears spaced-apart and rotationally mounted to the carrier, each planet gear having planet gear teeth extending parallel to the drive axis, the planet gears fit meshed between the drive teeth and the sun gear teeth, wherein rotation of the tool head in the second direction while the user holds the carrier outside surface stationary rotates the drive in the first direction.

2. The ratchet tool according to claim 1, wherein the at least one pawl comprises two pawls, and the at least one concave seat comprises two concave seats on diametrically opposite sides of the cylinder, each pawl mounted into one of the seats and engageable to the drive teeth to prevent relative rotation between the cylinder and the tool head when the tool head is rotated in the first direction but to allow relative rotation between the tool head and the cylinder when the tool head is rotated in the second direction.

3. The ratchet tool according to claim 2, wherein the two concave seats each comprise a semi-cylindrical seat and the two pawls each comprise an outer semi-cylindrical surface closely fitting into the respective semi-cylindrical surface of one of the semi-cylindrical seats.

4. The ratchet tool according to claim 1, wherein the drive output comprises a socket drive.

5. The ratchet tool according to claim 1, wherein the drive output, the sun gear and the drive input are all formed together as a unitary part.

6. The ratchet tool according to claim 1, wherein the carrier comprises a round disk.

7. The ratchet tool according to claim 1, wherein the tool head comprises an outer body and an inner gear fixedly mounted into the outer body, the inner gear providing the drive teeth.

8. The ratchet tool according to claim 7, wherein the inner gear has outer threads and the outer body has inner threads and the inner gear is threaded into the outer body.

9. The ratchet tool according to claim 1, wherein the ratchet mechanism is reversible such that the first direction is either clockwise or counterclockwise.

10. The ratchet tool according to claim 1, wherein the carrier is mounted onto an output side of the tool head and the carrier includes a central opening on the drive axis, wherein the drive output extends through the central opening.

11. The ratchet tool according to claim 1 wherein the cylinder has hollow regions and a mechanism for actuating the at least one pawl is housed within the hollow regions.

12. The ratchet tool according to claim 1, wherein the at least one concave seat comprises at least one semi-cylindrical seat and the at least one pawl comprises an outer semi-cylindrical surface closely fitting into the semi-cylindrical surface of the at least one semi-cylindrical seat.

13. A ratchet tool comprising:

a tool head having a cavity with a drive axis and an inside circumference with drive teeth extending parallel to the drive axis around the inside circumference;

a drive having a drive output to impart rotation to an object and a drive input to receive torque for rotating the output, and having a sun gear having sun gear teeth extending parallel to the drive axis around an outer circumference of the sun gear;

a ratchet mechanism mounted to the tool head and operative to directly couple the tool head to the input when the tool head is rotated in a first direction and to uncouple the tool head from the input when the tool head is rotated in a second opposite direction;

a carrier having a carrier outside surface engageable by a user's finger, the carrier rotationally mounted to the tool head to rotate about the drive axis;

a plurality of planet gears spaced-apart and rotationally mounted to the carrier, each planet gear having planet gear teeth extending parallel to the drive axis, the planet gears fit meshed between the drive teeth and the sun gear teeth, wherein rotation of the tool head in the second direction while the user holds the carrier outside surface stationary rotates the drive in the first direction;

wherein the drive input comprises a cylinder coaxially connected to the sun gear; and wherein the ratchet mechanism comprises a selector having a finger-engageable operator connected to a selector shaft that is elongated parallel to the drive axis, a spring tube extending transversly through the selector shaft, a spring residing inside the spring tube, pins extending from opposite ends of the spring to be urged away from each other by the spring, and a pair of pawls each pressed by each pin away from each other, the cylinder having an axial bore to receive the selector shaft and a through-passage to receive the spring tube, and the pawls are mounted to the cylinder to extend between the drive teeth and an outside circumference of the cylinder on opposite sides of the cylinder, and the pawls are engageable to the drive teeth to prevent relative rotation between the cylinder and the tool head when the tool head is rotated in the first direction but to allow relative rotation between the tool head and the cylinder when the tool head is rotated in the second direction.

14. The ratchet tool according to claim 13, wherein the through-passage is oversized to allow rotation of the spring tube about the drive axis within the cylinder, and wherein the rotation of the spring tube causes the pin to pivot each pawl to a degree that reverses operation of the ratchet mechanism from the first direction being clockwise to the first direction being counterclockwise.

15. The ratchet tool according to claim 14, wherein the cylinder comprises two semi-cylindrical seats and each of the two pawls comprise an outer semi-cylindrical surface closely fitting into the respective semi-cylindrical surface of one of the semi-cylindrical seats allowing the pawls to rotate within the seats to pivot to reverse operation of the ratchet mechanism.

16. A ratchet tool comprising:

a tool head having a cavity with a drive axis and an inside circumference with drive teeth extending parallel to the drive axis around the inside circumference;

a drive having a drive output to impart rotation to an object and a drive input within the cavity to receive torque for rotating the output, the drive input and output being directly coupled, and having a sun gear having sun gear teeth extending parallel to the drive axis around an outer circumference of the sun gear, the drive input comprises a cylinder coaxially connected to the sun gear;

a ratchet mechanism mounted between the tool head and the drive input and operative to directly couple the tool head to the input when the tool head is rotated in a first direction and to uncouple the tool head from the input when the tool head is rotated in a second opposite direction, wherein while the tool head is rotated in the first direction, the ratchet mechanism couples for common rotation the drive teeth of the tool head to the sun gear of the drive;

a carrier having a carrier outside surface engageable by a user's finger, the carrier rotationally mounted to the tool head to rotate about the drive axis;

a plurality of planet gears spaced-apart and rotationally mounted to the carrier, each planet gear having planet gear teeth extending parallel to the drive axis, the planet wars fit meshed between the drive teeth and the sun gear teeth, wherein rotation of the tool head in the second direction while the user holds the carrier outside surface stationary rotates the drive in the first direction;

wherein the drive input comprises a cylinder coaxially formed as one piece with the sun gear and the drive output, and wherein the cylinder has a diameter sized to present an annular gap between the cylinder and the drive teeth, and the ratchet mechanism comprises at least one pawl located at least partially within the gap and actuatable to prevent relative rotation between the cylinder and the tool head when the tool head is rotated in the first direction but allows relative rotation between the tool head and the cylinder when the tool head is rotated in the second direction, wherein the cylinder has hollow regions and a mechanism for actuating the at least one pawl is housed within the hollow regions.

17. The ratchet tool according to claim 16, wherein the carrier is mounted onto an output side of the tool head and the carrier includes a central opening on the drive axis, wherein the drive output extends through the central opening.

18. The ratchet tool according to claim 17, wherein the cylinder has at least one concave seat open toward the gap, and the at least one pawl is mounted in the at least one seat.

19. The ratchet tool according to claim 17, wherein the tool head comprises an outer body and an inner gear fixedly mounted into the outer body, the inner gear providing the drive teeth.

* * * * *